US008310477B2

(12) United States Patent
Shin et al.

(10) Patent No.: US 8,310,477 B2
(45) Date of Patent: Nov. 13, 2012

(54) POWER CIRCUIT AND LIQUID CRYSTAL DISPLAY HAVING THE SAME

(75) Inventors: Ok-Kwon Shin, Cheonan-si (KR); Seung-Hwan Moon, Yongin-si (KR); Sun-Kyu Son, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 618 days.

(21) Appl. No.: 12/391,734

(22) Filed: Feb. 24, 2009

(65) Prior Publication Data

US 2010/0020057 A1 Jan. 28, 2010

(30) Foreign Application Priority Data

Jul. 28, 2008 (KR) ..... 10-2008-0073597

(51) Int. Cl.
*G09G 5/00* (2006.01)
*G09G 3/36* (2006.01)

(52) U.S. Cl. ..... 345/211; 345/87; 345/204

(58) Field of Classification Search ..... None
See application file for complete search history.

(56) References Cited

U.S. PATENT DOCUMENTS 6,476,591 B2 * 11/2002 Yamaguchi et al. ..... 323/369

FOREIGN PATENT DOCUMENTS

JP 2003337318 A 11/2003
JP 2007093696 A 4/2007
JP 2008026512 A 2/2008

* cited by examiner

*Primary Examiner* — Andrew L Sniezek
(74) *Attorney, Agent, or Firm* — Cantor Colburn LLP

(57) ABSTRACT

A power circuit for a liquid crystal display includes a voltage divider which generates a voltage-divided voltage between a first power source and a second power source, an operational amplifier which receives the voltage-divided voltage to output a driving voltage, a first switch connected between the first power source and a common node, and a second switch connected between the second power source and the common node. The first switch provides a first current path between the first power source and the common node in response to the driving voltage, and the second switch provides a second current path between the second power source and the common node in response to the driving voltage.

8 Claims, 8 Drawing Sheets

Fig. 7

40" FHD 120Hz(IC 8ea Drive)

| Gray | Test Pattern | Node(N1) Voltage | $I_A$ | Emitter Current($I_8$) | Source Current($I_7$) | Sink Current ($I_6$) | Temperature | |
|---|---|---|---|---|---|---|---|---|
| | | | | | | | NPN | PNP |
| 256G | White | 7.661V | 32.17mA | 5.465mA | 61mA | 52mA | 31.8℃ | 32.2℃ |
| | Black | 7.607V | 28.65mA | 7.972mA | 77mA | 73mA | 31.1℃ | 31.9℃ |
| | Checker | 7.641V | 82.87mA | 57.73mA | 424mA | 425mA | 45.5℃ | 38.8℃ |
| | H-Stripe | 7.616V | 308.6mA | 47.56mA | 519mA | 533mA | 41.0℃ | 38.7℃ |
| | Sub Checker | 7.618V | 85.88mA | 60.54mA | 413mA | 423mA | 46.2℃ | 38.9℃ |
| 180G | White | 7.580V | 66.06mA | 65.37mA | 296mA | 300mA | 37.2℃ | 37.6℃ |
| | Checker | 7.575V | 71.64mA | 66.81mA | 311mA | 315mA | 38.0℃ | 38.5℃ |
| | H-Stripe | 7.576V | 202.8mA | 35.95mA | 374mA | 393mA | 36.3℃ | 38.1℃ |
| | Sub Checker | 7.584V | 144.8mA | 207.5mA | 323mA | 309mA | 75.2℃ | 70.5℃ |

Fig. 8

52" FHD 120Hz(960ch IC 6ea Drive)

| Gray | Test Pattern | Node(N1) Voltage | $I_A$ | Emitter Current($I_8$) | Source Current(I ) | Sink Current ($I_6$) | Temperature | |
|---|---|---|---|---|---|---|---|---|
| | | | | | | | NPN | PNP |
| 256G | White | 7.622V | 80mA | 52.09mA | 68.47mA | 35.33mA | 43.0℃ | 45.3℃ |
| | Black | 7.615V | 63mA | 24.14mA | 68.36mA | 23.38mA | 47.0℃ | 47.8℃ |
| | Checker | 7.646V | 264mA | 55.56mA | 412.7mA | 380.1mA | 65.7℃ | 63.6℃ |
| | H-Stripe | 7.635V | 234mA | 50.45mA | 594.3mA | 514.0mA | 67.6℃ | 65.2℃ |
| | Sub Checker | 7.630V | 252mA | 50.08mA | 390.5mA | 358.3mA | 67.8℃ | 64.6℃ |
| 180G | White | 7.591V | 110.06mA | 32.73mA | 147.2mA | 119.6mA | 58.5℃ | 58.1℃ |
| | Checker | 7.574V | 221.64mA | 65.12mA | 310.9mA | 291.6mA | 70.5℃ | 68.8℃ |
| | H-Stripe | 7.571V | 202.8mA | 66.43mA | 323.4mA | 274.9mA | 66.8℃ | 65.1℃ |
| | Sub Checker | 7.584V | 322.8mA | 120.8mA | 270.3mA | 160.6mA | 70.5℃ | 68.8℃ |

Fig. 9

| Test Pattern | 414 Channel | 576 Channel | 720 Channel | 960 Channel |
|---|---|---|---|---|
| White | 66.5° C | 83.4℃ | 139.1℃ | 60.7℃ |
| Black | 58.7° C | 63.1℃ | 90.3℃ | 57.6℃ |
| Checker | 70.8° C | 106.6℃ | 153.1℃ | 89.1℃ |
| H-Stripe | 68.9° C | 115.7℃ | 158.7℃ | 89.6℃ |
| Sub Checker | 68.9° C | 94.6℃ | 141.9℃ | 89.2℃ |

POWER CIRCUIT AND LIQUID CRYSTAL DISPLAY HAVING THE SAME

This application claims priority to Korean Patent Application No. 2008-0073597, filed on Jul. 28, 2008, and all the benefits accruing from under 35 U.S.C. §119, the contents of which in its entirety are herein incorporated by reference.

BACKGROUND OF THE INVENTION

1. Field of the Invention

The present invention relates to a power circuit and a liquid crystal display having the power circuit.

2. Description of the Related Art

As one type of many flat panel displays, a liquid crystal display displays an image using a light transmittance of liquid crystal. The liquid crystal display has various advantages such as being lightweight, thin, requiring a low driving voltage, and having low power consumption. Thus, the liquid crystal display is widely applied to various industries based on these advantages over other types of flat panel displays.

The liquid crystal display includes a display panel which displays the image using light and a backlight assembly which supplies the light to the display panel. The display panel includes an array substrate on which thin film transistors are formed, an opposite substrate facing the array substrate, and a liquid crystal layer interposed between the array substrate and the opposite substrate. In addition, the liquid crystal display further includes a driving chip electrically connected to the array substrate to apply a driving signal to the display panel.

Since the driving chip has a tendency to heat up when operated for long periods of time, the driving chip is vulnerable to changes in temperature. In addition, the driving chip is connected to an upper side portion of the display panel, and thus the driving chip is more directly affected from increases in the ambient temperature. Recently, in order to reduce the number of the driving chips, a multi-channel driving chip has been developed. However, the multi-channel driving chip is even more vulnerable to changes in temperature of the liquid crystal display.

BRIEF SUMMARY OF THE INVENTION

Therefore, an exemplary embodiment of the present invention provides a power circuit for a liquid crystal display, capable of lowering a temperature of a driving chip applied to the liquid crystal display.

Another exemplary embodiment of the present invention provides a liquid crystal display having the power circuit.

In an exemplary embodiment of the present invention, a power circuit for a liquid crystal display includes a voltage divider, an operational amplifier, a first switch, and a second switch. The voltage divider generates a voltage-divided voltage between a first power source and a second power source. The operational amplifier receives the voltage-divided voltage to output a driving voltage. The first switch is connected between the first power source and a common node to provide a first current path between the first power source and the common node in response to the driving voltage. The second switch is connected between the second power source and the common node to provide a second current path between the second power source and the common node in response to the driving voltage.

The first switch includes a first bipolar transistor of which a first terminal is connected to the first power source, a second terminal is connected to the common node, and a third terminal is connected to the driving voltage, and the second switch includes a second bipolar transistor of which a first terminal is connected to the common node, a second terminal is connected to the second power source, and a third terminal is connected to the driving voltage.

The operational amplifier includes a first input terminal connected to the voltage-divided voltage and a second input terminal connected to an output terminal thereof from which the driving voltage is output.

The power circuit further includes a first resistor connected between the output terminal of the operational amplifier and the third terminal of the first bipolar transistor and a second resistor connected between the output terminal of the operational amplifier and the third terminal of the second bipolar transistor.

The voltage divider includes at least two resistors connected in series between the first power source and the second power source, and a voltage at a connection node to which the two resistors are connected serves as the voltage-divided voltage.

In another exemplary embodiment of the present invention, a liquid crystal display includes a driving chip and a power circuit which applies a plurality of powers to the driving chip through first, second, third and fourth terminals of the driving chip.

The power circuit includes a voltage divider, an operational amplifier, a first switch, and a second switch. The voltage divider is connected between the first terminal to which a first voltage is applied and the fourth terminal to which a second voltage is applied, the voltage divider generates a voltage-divided voltage. The operational amplifier receives the voltage-divided voltage to output a driving voltage. The first switch is connected between the first terminal and a common node to provide a first current path between the first terminal and the common node in response to the driving voltage. The second switch is connected between the fourth terminal and the common node to provide a second current path between the fourth terminal and the common node in response to the driving voltage. The common node is commonly connected to the second and third terminals of the driving chip.

The driving chip includes a plurality of output terminals respectively corresponding to a plurality of column lines, and the column lines are operated at a column inversion drive scheme.

According to the above, although the liquid crystal display employs the driving chip having a plurality of channels, the operating temperature of the driving chip may be lowered.

BRIEF DESCRIPTION OF THE DRAWINGS

The above and other aspects, advantages and features of the present invention will become readily apparent by reference to the following detailed description when considered in conjunction with the accompanying drawings wherein:

FIGS. 7 and 8 are tables showing test results of tests performed using test patterns with respect to a liquid crystal display employing the power circuit shown in FIG. 6; and FIG. 9 is a is a table showing test results of tests performed using driving chips having different channel numbers with respect to a liquid crystal display having a resolution of FHD, an operating frequency of 120 Hz, and a power circuit according to the present invention.

DETAILED DESCRIPTION OF THE INVENTION

Figure 1:
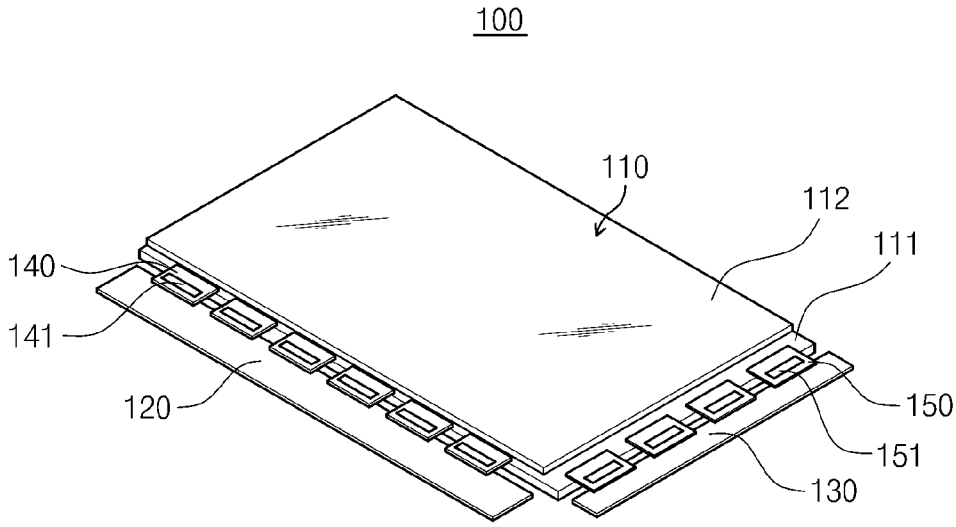
FIG. 1 is a perspective view showing an exemplary embodiment of a display unit according to the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in further detail with reference to the accompanying drawings.

FIG. 1 is a perspective view showing an exemplary embodiment of a display unit according to the present invention.

Referring to FIG. 1, a liquid crystal display 100 includes a liquid crystal display panel 110, a source printed circuit board 120 and a gate printed circuit board 130. The liquid crystal display panel 110 includes a thin film transistor ("TFT") substrate 111, a color filter substrate 112 coupled with and facing the TFT substrate 111, and a liquid crystal layer (not shown) interposed between the TFT substrate 111 and the color filter substrate 112.

The TFT substrate 111 is a transparent glass substrate on which thin film transistors ("TFTs") are arranged in a matrix. Each of the TFTs includes a source terminal connected to a source line, a gate terminal connected to a gate line and a drain electrode connected to a pixel electrode (all not shown).

When the TFTs are turned on in response to power applied to the gate terminal thereof, an electric field is generated between a common electrode (not shown) arranged on the color filter substrate 112 and a pixel electrode (not shown) arranged on the TFT substrate 111. Due to the electric field, arrangements of liquid crystal molecules of the liquid crystal layer (not shown) disposed between the TFT substrate 111 and the color filter substrate 112 are varied and light transmittance of light passing through the liquid crystal molecules are varied, thereby displaying desired images.

The source printed circuit board 120 and the gate printed circuit board 130 are connected to the liquid crystal display panel 110 by a source driving circuit film 140 and a gate driving circuit film 150, respectively, and apply image signals and scan signals, respectively, to drive the liquid crystal display panel 110. The source and gate driving circuit films 140 and 150 may be a tape carrier package ("TCP") or a chip on film ("COF"). In the present exemplary embodiment, in order to timely apply driving signals to the liquid crystal display panel 110 from the source printed circuit board 120, each of the source driving circuit films 140 may further include a source driving chip 141 and each of the gate driving circuit films 150 may further include a gate driving chip 151.

The number of the source driving chips 141 and the number of the gate driving chips 151 are determined depending on a resolution of the liquid crystal display panel 110, the number of channels of the driving chip 141, 151, an operation frequency, etc. Table 1 below shows the number of the source driving chips 141 applied to the liquid crystal display 100 having a resolution of 1920×1080 (FHD) according to the operating frequency and the number of channels.

TABLE 1

| Operating frequency | 414 channels | 576 channels | 720 channels | 960 channels |
|---|---|---|---|---|
| 60 Hz | 14 | 10 | 8 | 6 |
| 120 Hz | 28 | 20 | 16 | 12 |
| 240 Hz | 56 | 40 | 32 | 24 |

For instance, if the source driving chip 141 has 720 channels and the operating frequency of 240 Hz, the liquid crystal display 100 includes at least thirty-two (32) source driving chips 141, however, it is difficult to arrange the thirty-two (32) source driving chips 141 on the source printed circuit board 120.

If the number of channels of the source driving chip 141 increases to 960, the number of source driving chips 141 for the source printed circuit board 120 decreases to twenty-four (24) when the operating frequency is 240 Hz. However, as the number of channels of the source driving chip 141 increases, an operating temperature of the source driving chip 141 increases. Table 2 below shows temperature variations according to the number of channels of the source driving chip 141 when various test patterns are applied to the liquid crystal display 100 having 1920×1080 full high definition ("FHD") resolution.

TABLE 2

| Test pattern | 414 channels | 576 channels | 720 channels | 960 channels | 1026 channels |
|---|---|---|---|---|---|
| White | 66.5 | 83.4 | 139.1 | 159.5 | 170.5 |
| Black | 58.7 | 63.1 | 90.3 | 120.5 | 128.8 |
| Checker | 70.8 | 106.6 | 153.1 | 182.0 | 194.5 |
| H-stripe | 68.9 | 115.7 | 158.7 | 188.0 | 200.9 |
| Sub-checker | 68.8 | 94.6 | 141.9 | 168.8 | 180.4 |
| Sub-Vstripe | 65.7 | 82.9 | 128.7 | 154.0 | 164.6 |

As shown in Table 2 above, as the number of channels of the source driving chips 141 increases, the operating temperature increases. Particularly, the operating temperature exceeds the critical point of 150 Celsius degrees in most test patterns applied to the source driving chips 141 having 960 channels. Thus, although the number of channels of the source driving chip 141 increases, it is desirable to reduce the operating temperature of the liquid crystal display.

Figure 2:
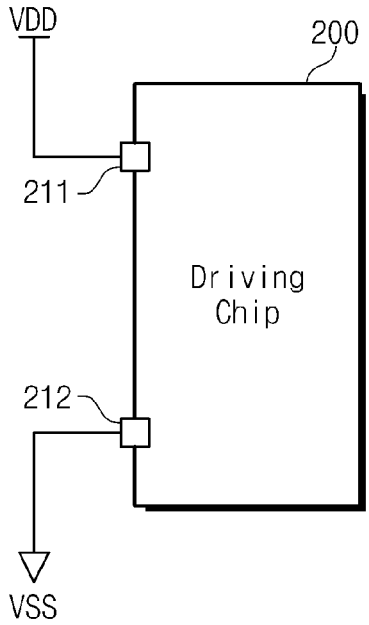
FIG. 2 is a schematic view showing a driving chip to which a power source is applied.

FIG. 2 is a schematic view showing a driving chip to which a power source is applied.

Referring to FIG. 2, a driving chip 200 includes a first power terminal 211 to which a power voltage VDD is applied and a second power terminal 212 to which a ground voltage VSS is applied. When assuming that a current flowing through the first power terminal 211 is $I_A$, an electric power consumed in the liquid crystal display panel 110 is represented as $VDD \times I_A$. Also, the electric power consumed in the driving chip 200 may be represented as $VDD \times I_A$.

Recently, the liquid crystal display 110 has become larger in scale and is required to have higher operating speed circuits in order to improve image display quality, thus increasing the voltage level of the power voltage VDD. For instance, if the power voltage VDD increases from 5 volts to 15 volts, an electric potential difference between the power voltage VDD and the ground voltage VSS also increases, thus increasing the power consumption in the liquid crystal display panel 110. Further, the power consumption of the driving chip 200 also increases, thereby causing an increase in the operating temperature of the driving chip 200.

Figure 3:
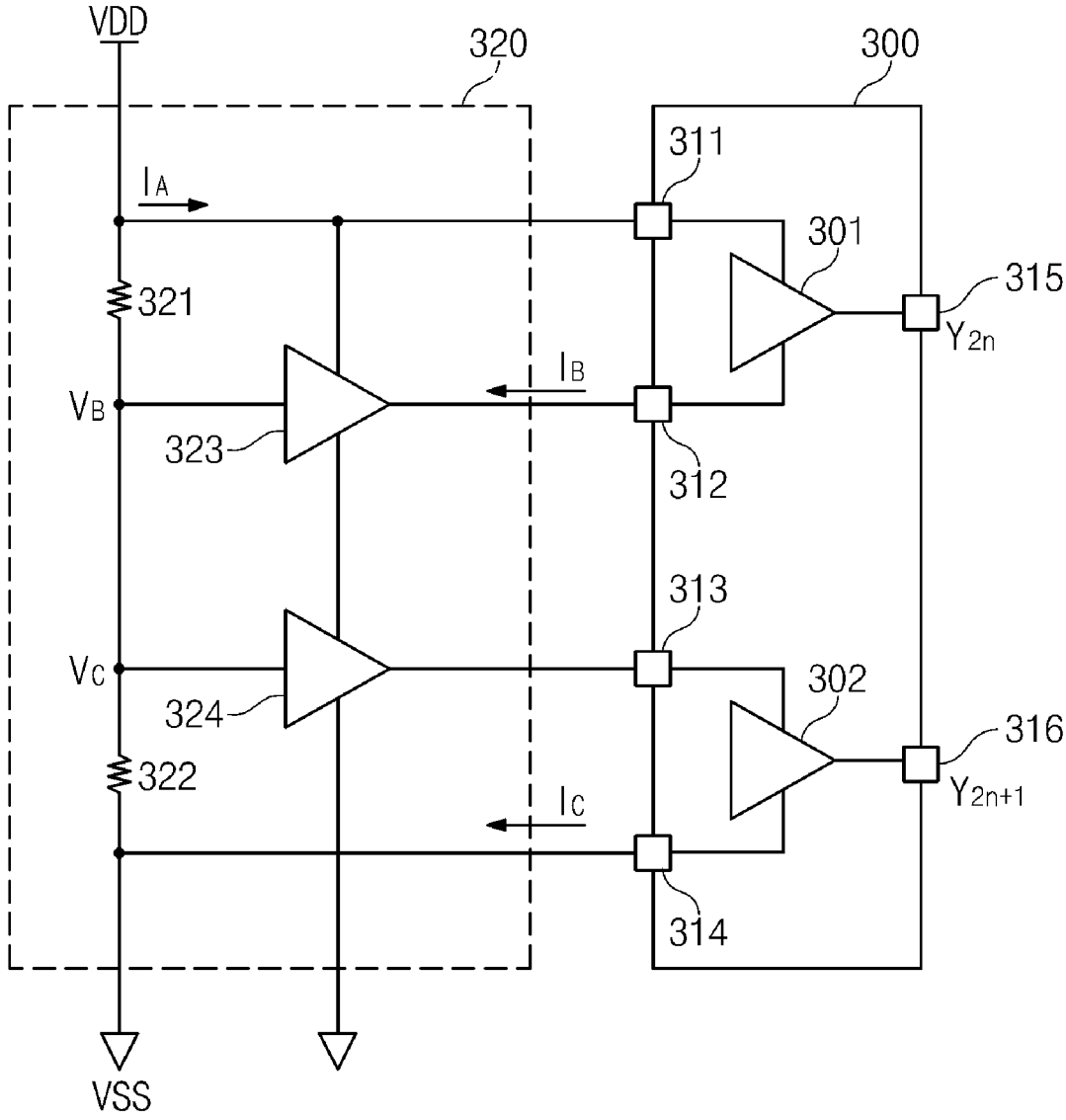
FIG. 3 is a circuit schematic diagram showing an exemplary embodiment of a power circuit for a liquid crystal display according to the present invention.

FIG. 3 is a circuit schematic diagram showing an exemplary embodiment of a power circuit for a liquid crystal display according to the present invention.

Referring to FIG. 3, a power circuit 320 includes resistors 321 and 322 and operational amplifiers 323 and 324. A driving chip 300 includes four power terminals 311, 312, 313 and 314, amplifiers 301 and 302, and output terminals 315 and 316. The output terminals 315 and 316 of the driving chip 300 output signals applied to drive column lines (not shown) of the liquid crystal display panel 110.

The resistors 321 and 322 are sequentially connected in series between the power voltage VDD and the ground voltage VSS. The operational amplifier 323 is connected between a connection node of the resistors 321 and 322 and the power terminal 312 of the driving chip 300, and the operational amplifier 324 is connected to the connection node of the resistors 321 and 322 and the power terminal 313 of the driving chip 300. The operational amplifiers 323 and 324 sequentially receive the power voltage VDD.

In the present exemplary embodiment, a voltage $V_B$ at the connection node $V_B$ of the resistors 321 and 322 is VDD/2. If the liquid crystal display 100 employs a column inversion drive scheme, the liquid crystal display 100 applies a data voltage whose polarity is inverted every frame to the column lines. The power circuit 320 according to the present exemplary embodiment directly applies the voltage $V_B$ to the driving chip 300, which is used as a reference voltage for the polarity inversion of the data voltage.

When the power circuit 320 is applied to the liquid crystal display panel 110, the electric power consumed in the liquid crystal display panel 110 is represented as $VDD \times (I_B + I_C)$, and the electric power consumed in the driving chip 300 is represented as $(VDD - V_B) \times I_B + V_C \times I_C = (VDD \times I_A)/2$. That is, the power consumption may be decreased to ½ compared to a conventional liquid crystal display panel. The current generated in the power circuit 320 is applied to the ground voltage VSS through the power terminals 311 and 312 and the operational amplifier 323. In this case, the current flowing into the operational amplifier 323 is above 500 mA, and the operational amplifier 323 is required to endure the over current condition.

Figure 4:
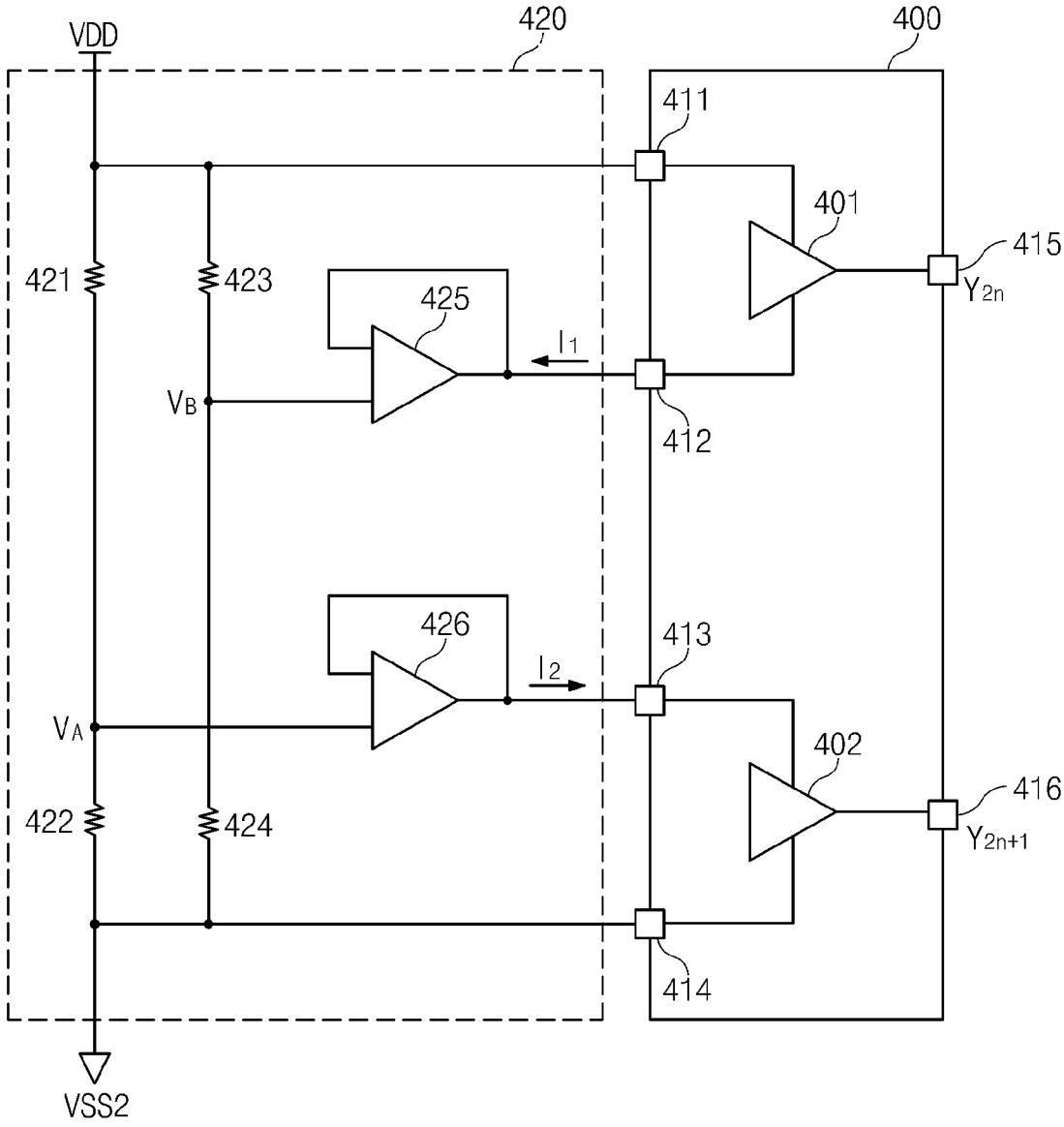
FIG. 4 is a circuit schematic diagram showing another exemplary embodiment of a power circuit for a liquid crystal display according to the present invention.

FIG. 4 is a circuit schematic diagram showing another exemplary embodiment of a power circuit for a liquid crystal display according to the present invention.

Referring to FIG. 4, a power circuit 420 includes resistors 421, 422, 423 and 424 and operational amplifiers 425 and 426. The resistors 421 and 422 are sequentially connected in series between the power voltage VDD and the ground voltage VSS, respectively, and the resistors 423 424 are sequentially connected in series between the power voltage VDD and the ground voltage VSS. Each of the operational amplifiers 425 and 426 includes a voltage-follower-type operational amplifier in which one of two input terminals thereof is connected to an output terminal thereof. Another input terminal of the operational amplifier 425 is connected to a voltage $V_B$ at a connection node of the resistors 423 and 424, and another input terminal of the operational amplifier 426 is connected to a voltage $V_A$ at a connection node of the resistors 421 and 422. A driving chip 400 includes four power terminals 411, 412, 413 and 414, amplifiers 401 and 402, and output terminals 415 and 416. The power terminal 411 of the driving chip 400 receives the power voltage VDD, the power terminals 412 and 413 are connected to the output terminals of the operational amplifiers 425 and 426, respectively, and the power terminal 414 is connected to the ground voltage VSS.

The power circuit 420 applies the voltage $V_B$ voltage-divided by the resistors 423 and 424 and the voltage $V_A$ voltage-divided by the resistors 421 and 422 to the power terminals 412 and 413, respectively, of the driving chip 400, so that the electric power consumed in the driving chip 400 may be reduced. However, the current $I_1$ flowing into the operational amplifier 425 of the power circuit 420 is still undesirably too high.

Figure 5:
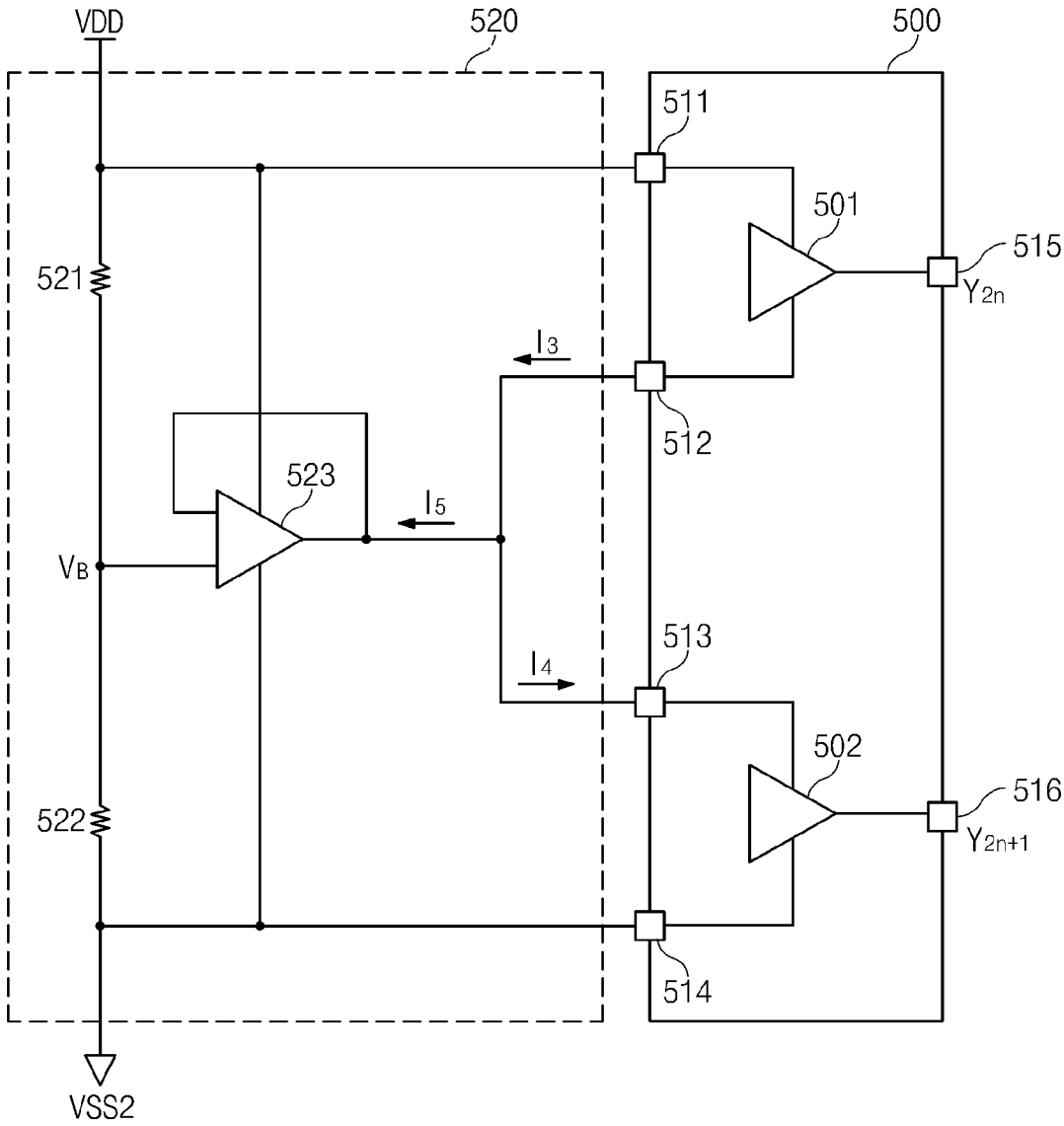
FIG. 5 is a circuit schematic diagram showing another exemplary embodiment of a power circuit for a liquid crystal display according to the present invention.

FIG. 5 is a circuit schematic diagram showing another exemplary embodiment of a power circuit for a liquid crystal display according to the present invention.

Referring to FIG. 5, a power circuit 520 includes resistors 521 and 522 and an operational amplifier 523. The resistors 521 and 522 are sequentially connected in series between the power voltage VDD and the ground voltage VSS. The operational amplifier 523 includes a voltage-follower-type operational amplifier of which one of two input terminals thereof is connected to an output terminal thereof. Another input terminal of the operational amplifier 523 is connected to a voltage $V_B$ at a connection node of the resistors 521 and 522. A driving chip 500 includes four power terminals 511, 512, 513 and 514, amplifiers 501 and 502, and output terminals 515 and 516. The power terminal 511 of the driving chip 500 receives the power voltage VDD, the power terminals 512 and 513 are commonly connected to the output terminal of the operational amplifier 523, and the power terminal 514 is connected to the ground voltage VSS.

Since the power circuit 520 applies the voltage $V_B$ voltage-divided by the resistors 521 and 522 to the power terminals 512 and 513 of the driving chip 500, the electric power consumed in the driving chip 500 may be reduced as described in FIG. 3. Particularly, a portion of a current $I_3$, which is provided to the driving chip 500 through the power terminal 511 from the power voltage VDD and output from the power terminal 512 through the amplifier 501, is applied to the driving chip 500 through the power terminal 513, and a remaining portion of the current $I_3$ flows into the operational amplifier 523. The current $I_5$ flowing into the operational amplifier 523 is smaller than that flowing into the operational amplifiers shown in FIGS. 3 and 4, however the over current stills flows into the operational amplifier 523 with respect to a specific test pattern. According to simulated results, in a case in which the test pattern is a sub-checker test pattern in 180 grays of which two adjacent column lines $Y_{2n}$ and $Y_{2n+1}$ have the maximum voltage difference between them, the current flowed into the operational amplifier is about 191.3 mA. Therefore, a circuit configuration which applies the voltage $V_B$ to the power terminals 512 and 513 of the driving chip 500 without using the operational amplifier 523 is required.

Figure 6:
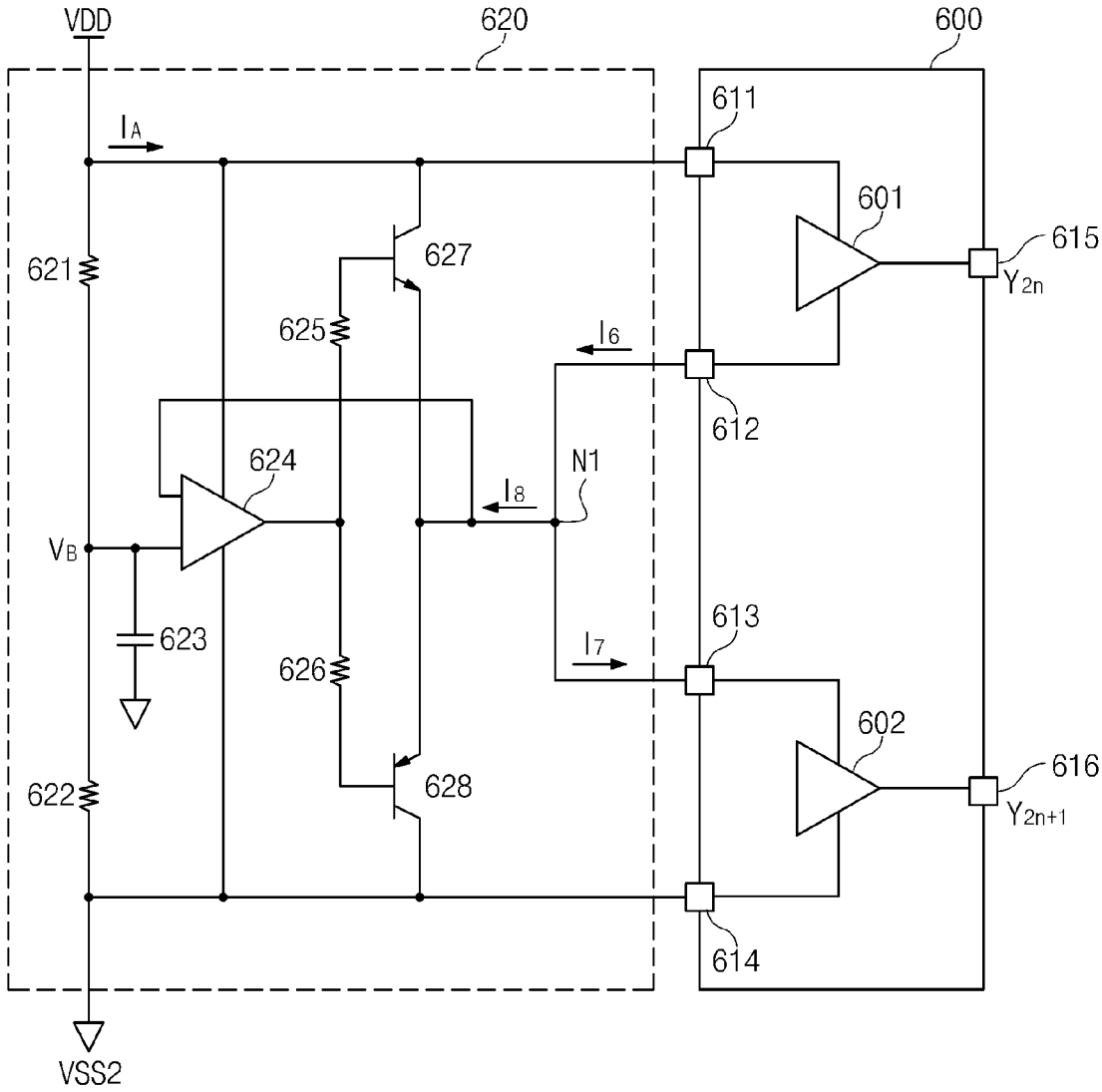
FIG. 6 is a circuit schematic diagram showing another exemplary embodiment of a power circuit for a liquid crystal display according to the present invention.

FIG. 6 is a circuit schematic diagram showing another exemplary embodiment of a power circuit for a liquid crystal display according to the present invention.

Referring to FIG. 6, a power circuit 620 includes resistors 621, 622, 625 and 626, an operational amplifier 624, and transistors 627 and 628. The resistors 621 and 622 are sequentially connected in series between the power voltage VDD and the ground voltage VSS. One of two input terminals of the operational amplifier 624 is connected to a voltage $V_B$ of a connection node of the resistors 621 and 622 and another input terminal of the operational amplifier 624 is connected to a common node N1. Each of the transistors 627 and 628 includes a bipolar junction transistor ("BJT"). Particularly, the transistor 627 is an NPN-type transistor and the transistor 628 is a PNP-type transistor. The NPN-type transistor 627 includes a collector terminal connected to the power voltage VDD, an emitter terminal connected to the common node N1, and a base terminal connected to an output terminal of the operational amplifier 624 through the resistor 625. The PNP-type transistor 628 includes an emitter terminal connected to the common node N1, a collector terminal connected to the ground voltage VSS, and a base terminal connected to the output terminal of the operational amplifier 624 through the resistor 626.

A driving chip 600 includes four power terminals 611, 612, 613 and 614, amplifiers 601 and 602, and output terminals 615 and 616. The power terminal 611 of the driving chip 600 receives the power voltage VDD, the power terminals 612 and 613 are connected to the common node N1 of the power circuit 620, and the power terminal 614 is connected to the ground voltage VSS.

The voltage-divided voltage $V_B$ is applied to the common node N1 by the operational amplifier 624. A portion of a current $I_6$ output from the power terminal 612 of the driving chip 600 flows into the power terminal 613 as a current $I_7$, and a remaining portion of the current $I_6$ flows into the ground voltage VSS through the transistor 628 as a current $I_S$. The current $I_7$ flowing into the power terminal 613 includes portions of a current $I_A$ provided from the power voltage VDD through the transistor 627 and the portion of the current $I_6$ output from the power terminal 612.

The output terminal of the operational amplifier 624 is separated from the common node N1, so that the current output from the power terminal 612 of the driving chip 600 does not flow into the operational amplifier 624. Further, since the transistor 628 may be operated under relatively high current conditions and relatively high power conditions, the power circuit 620 may still be operated stably.

FIGS. 7 and 8 are tables showing test results of tests performed using test patterns with respect to a liquid crystal display employing the power circuit shown in FIG. 6. In FIGS. 7 and 8, "Gray" represents a gray-scale difference between two adjacent column lines $Y_{2n}$ and $Y_{2n+1}$. The test pattern is classified into white pattern, black pattern, checker pattern, H-stripe pattern, and sub-checker pattern constituted by the checker pattern and the H-stripe pattern according to images displayed on the liquid crystal display panel.

FIG. 7 shows the currents $I_6$, $I_7$ and $I_8$ and temperatures of the transistors 627 and 628 when pixel data signals corresponding to the various test patterns are applied to the liquid crystal display having 1920×1080 full high definition ("FHD") resolution, the operating frequency of 120 Hz, and the driving chip 600 of 720 channels.

Referring to FIG. 7, the maximum operating temperature of the transistors 627 and 628 has reached 75.2 Celsius degrees, so that the operating temperature of the transistors 627 and 628 is sufficiently lower than a temperature/tolerance margin of 125 Celsius degrees. In a case in which a transistor having a current margin of 3 A and an electric power margin of 2 W is applied to the power circuit 620 as the transistor 628 in FIG. 6, the power circuit 620 may operate stably even though the current of about 207.5 mA flows into the emitter terminal of the transistor 628 in the 180 grays and the sub-checker pattern.

FIG. 8 shows the currents $I_6$, $I_7$ and $I_8$ and temperatures of the transistors 627 and 628 of FIG. 6 when pixel data signals corresponding to the various test patterns are applied to the liquid crystal display having 1920×1080 FHD resolution, the operating frequency of 120 Hz, and the driving chip 600 of 720 channels.

Referring to FIG. 8, although the number of channels of the driving chip 620 increases to 960 channels, the maximum operating temperature of the transistors 627 and 628 has reached 70.5 Celsius degrees, so that the operating temperature of the transistors 627 and 628 is sufficiently lower than the temperature/tolerance margin of 125 Celsius degrees.

FIG. 9 is a table showing test results of tests performed using driving chips having different channel numbers with respect to the liquid crystal display having the 1920×1080 FHD resolution, the operating frequency of 120 Hz, and a power circuit according to the above-described exemplary embodiments.

Referring to FIG. 9, although the number of channels of the driving chips 141 increases to 960 channels, the maximum operating temperature of the transistors 627 and 628 of FIG. 6 has reached 89.6 Celsius degrees.

According to the above, although the liquid crystal display employs the driving chip having a plurality of channels, the operating temperature of the driving chip may be lowered.

Although the exemplary embodiments of the present invention have been described, it is understood that the present invention should not be limited to these exemplary embodiments but various changes and modifications can be made by one of ordinary skill in the art within the spirit and scope of the present invention as hereinafter claimed.

What is claimed is:

1. A power circuit for a liquid crystal display, comprising:

a voltage divider which generates a voltage-divided voltage between a first power source and a second power source;

an operational amplifier which receives the voltage-divided voltage to output a driving voltage;

a first switch connected between the first power source and a common node to provide a first current path between the first power source and the common node in response to the driving voltage received to a control terminal;

a second switch connected between the second power source and the common node to provide a second current path between the second power source and the common node in response to the driving voltage received to a control terminal;

a first resistor connected between a output terminal of the operational amplifier and the control terminal of the first switch; and a second resistor connected between the output terminal of the operational amplifier and the control terminal of the second switch, wherein the operational amplifier has a first input terminal connected to the voltage-divided voltage and a second input terminal connected to the common node.

2. The power circuit of claim 1, wherein the first switch comprises a first bipolar transistor of which a first terminal is connected to the first power source and a second terminal is connected to the common node, and the second switch comprises a second bipolar transistor of which a first terminal is connected to the common node, a second terminal is connected to the second power source.

3. The power circuit of claim 1, wherein the voltage divider comprises at least two resistors connected in series between the first power source and the second power source, and a voltage at a connection node to which the two resistors are connected serves as the voltage-divided voltage.

4. A liquid crystal display comprising:

a driving chip; and a power circuit which applies a plurality of powers to the driving chip through first, second, third and fourth terminals of the driving chip, wherein the power circuit comprises:

a voltage divider connected between the first terminal to which a first voltage is applied and the fourth terminal to which a second voltage is applied, the voltage divider generates a voltage-divided voltage;

an operational amplifier that receives the voltage-divided voltage to output a driving voltage;

a first switch connected between the first terminal and a common node to provide a first current path between the first terminal and the common node in response to the driving voltage received to a control terminal;

a second switch connected between the fourth terminal and the common node to provide a second current path between the fourth terminal and the common node in response to the driving voltage received to a control terminal, and the common node is commonly connected to the second and third terminals of the driving chip, a first resistor connected between a output terminal of the operational amplifier and the control terminal of the first switch; and a second resistor connected between the output terminal of the operational amplifier and the control terminal of the second switch, wherein the operational amplifier has a first input terminal connected to the voltage-divided voltage and a second input terminal connected to the common node.

5. The liquid crystal display of claim 4, wherein the driving chip comprises a plurality of output terminals respectively corresponding to a plurality of column lines.

6. The liquid crystal display of claim 5, wherein the column lines are operated at a column inversion drive scheme.

7. The liquid crystal display of claim 5, wherein the first switch comprises a first bipolar transistor of which a first terminal is connected to the first voltage, a second terminal is connected to the common node and the second switch comprises a second bipolar transistor of which a first terminal is connected to the common node, a second terminal is connected to the second voltage.

8. The liquid crystal display of claim 5, wherein the voltage divider comprises at least two resistors connected in series between the first voltage and the second voltage, and a voltage at a connection node to which the two resistors are connected serves as the voltage-divided voltage.

* * * * *